US010839990B2

(12) United States Patent
Yamada et al.

(10) Patent No.: US 10,839,990 B2
(45) Date of Patent: Nov. 17, 2020

(54) CHIP RESISTOR MANUFACTURING METHOD, AND CHIP RESISTOR

(71) Applicant: Panasonic Intellectual Property Management Co., Ltd., Osaka (JP)

(72) Inventors: Koichi Yamada, Fukui (JP); Shogo Nakayama, Fukui (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/341,094

(22) PCT Filed: Jan. 17, 2018

(86) PCT No.: PCT/JP2018/001116
§ 371 (c)(1),
(2) Date: Apr. 11, 2019

(87) PCT Pub. No.: WO2018/147014
PCT Pub. Date: Aug. 16, 2018

(65) Prior Publication Data

US 2020/0090839 A1 Mar. 19, 2020

(30) Foreign Application Priority Data

Feb. 8, 2017 (JP) ..... 2017-020860

(51) Int. Cl.
*H01C 1/142* (2006.01)
*H01C 7/00* (2006.01)
*H01C 17/28* (2006.01)

(52) U.S. Cl.
CPC ..... *H01C 1/142* (2013.01); *H01C 7/003* (2013.01); *H01C 17/281* (2013.01)

(58) Field of Classification Search
CPC ..... H01C 1/142; H01C 7/003; H01C 17/281
(Continued)

(56) References Cited

U.S. PATENT DOCUMENTS 6,242,999 B1 * 6/2001 Nakayama ..... H01C 1/14 338/307
2014/0333411 A1 11/2014 Yoneda
(Continued)

FOREIGN PATENT DOCUMENTS

JP 60-070753 * 4/1985 ..... H01L 27/01
JP 2013-153137 8/2013
JP 2016-072298 5/2016

OTHER PUBLICATIONS

International Search Report of PCT application No. PCT/JP2018/001116 dated Apr. 10, 2018.

*Primary Examiner* — Nguyen Tran
*Assistant Examiner* — Iman Malakooti
(74) *Attorney, Agent, or Firm* — McDermott Will & Emery LLP

(57) ABSTRACT

A chip resistor having a predetermined resistance value is manufactured by the following method. A resistive element is provided on an upper surface of an insulating substrate. The resistive element includes a wide portion, a first narrow portion extending from the wide portion, and a part extending from the wide portion, the first narrow portion has a smaller width than the wide portion. First and second electrodes are provided on the upper surface of the insulating substrate. The first electrode is located away from the wide portion. The first electrode contacts the first narrow portion. The first electrode overlaps the first narrow portion when viewed from above. The second electrode contacts the part of the resistive element. The second electrode overlaps the part of the resistive element when viewed from above. A distance between the narrow portion and the wide portion is determined so as to cause a resistance value between the first and second electrodes to be the predetermined resistance value. This method improves the precision of the resistance value of the chip resistor.

12 Claims, 9 Drawing Sheets

(58) Field of Classification Search
USPC ..... 338/308
See application file for complete search history.

(56) References Cited

U.S. PATENT DOCUMENTS

| | | | |
|---|---|---|---|
| 2017/0048983 | A1 | 2/2017 | Yoneda |
| 2017/0309378 | A1 | 10/2017 | Matsumoto |

* cited by examiner

CHIP RESISTOR MANUFACTURING METHOD, AND CHIP RESISTOR

CROSS-REFERENCE TO RELATED APPLICATIONS

This application is a U.S. national stage application of the PCT international application No. PCT/JP2018/001116 filed on Jan. 17, 2018, which claims the benefit of foreign priority of Japanese patent application No. 2017-020860 filed on Feb. 8, 2017, the contents all of which are incorporated herein by reference.

TECHNICAL FIELD

The present invention relates to a chip resistor used for various electronic devices including a thick-film resistive element.

BACKGROUND ART

FIG. 10 is a top plan view of a main portion of conventional chip resistor 500. FIG. 11 is a top plan view of conventional chip resistor 500. FIG. 12 is a cross-sectional view of chip resistor 500 along line XII-XII shown in FIG. 11. Chip resistor 500 includes insulating substrate 1, a pair of upper-surface electrodes 2 provided on both end portions of an upper surface of insulating substrate 1, resistive element 3 provided on the upper surface of insulating substrate 1 and between the pair of upper-surface electrodes 2, protective film 4 covering at least resistive element 3, a pair of end-surface electrodes 5 provided on both end faces of insulating substrate 1 so as to be electrically connected to the pair of upper-surface electrodes 2, and plated layer 6 formed on portions of the upper surfaces of electrodes 2 and on the surfaces of the pair of end-surface electrodes 5.

The pair of upper-surface electrodes 2 and resistive element 3 have rectangular shapes when viewed from above. Trimming groove 7 is formed in resistive element 3 to adjust the resistance value.

A conventional chip resistor similar to chip resistor 500 is disclosed in, e.g. PTL 1.

CITATION LIST

Patent Literature

PTL 1: Japanese Patent Laid-Open Publication No. 2013-153137

SUMMARY

A chip resistor having a predetermined resistance value is manufactured by the following method. A resistive element is provided on an upper surface of an insulating substrate. The resistive element includes a wide portion, a first narrow portion extending from the wide portion, and a part extending from the wide portion, the first narrow portion has a smaller width than the wide portion. First and second electrodes are provided on the upper surface of the insulating substrate. The first electrode is located away from the wide portion. The first electrode contacts the first narrow portion. The first electrode overlaps the first narrow portion when viewed from above. The second electrode contacts the part of the resistive element. The second electrode overlaps the part of the resistive element when viewed from above. A distance between the first electrode and the wide portion is determined so as to cause a resistance value between the first and second electrodes to be the predetermined resistance value.

This method improves the precision of the resistance value of the chip resistor.

DETAIL DESCRIPTION OF PREFERRED EMBODIMENT

Figure 1:
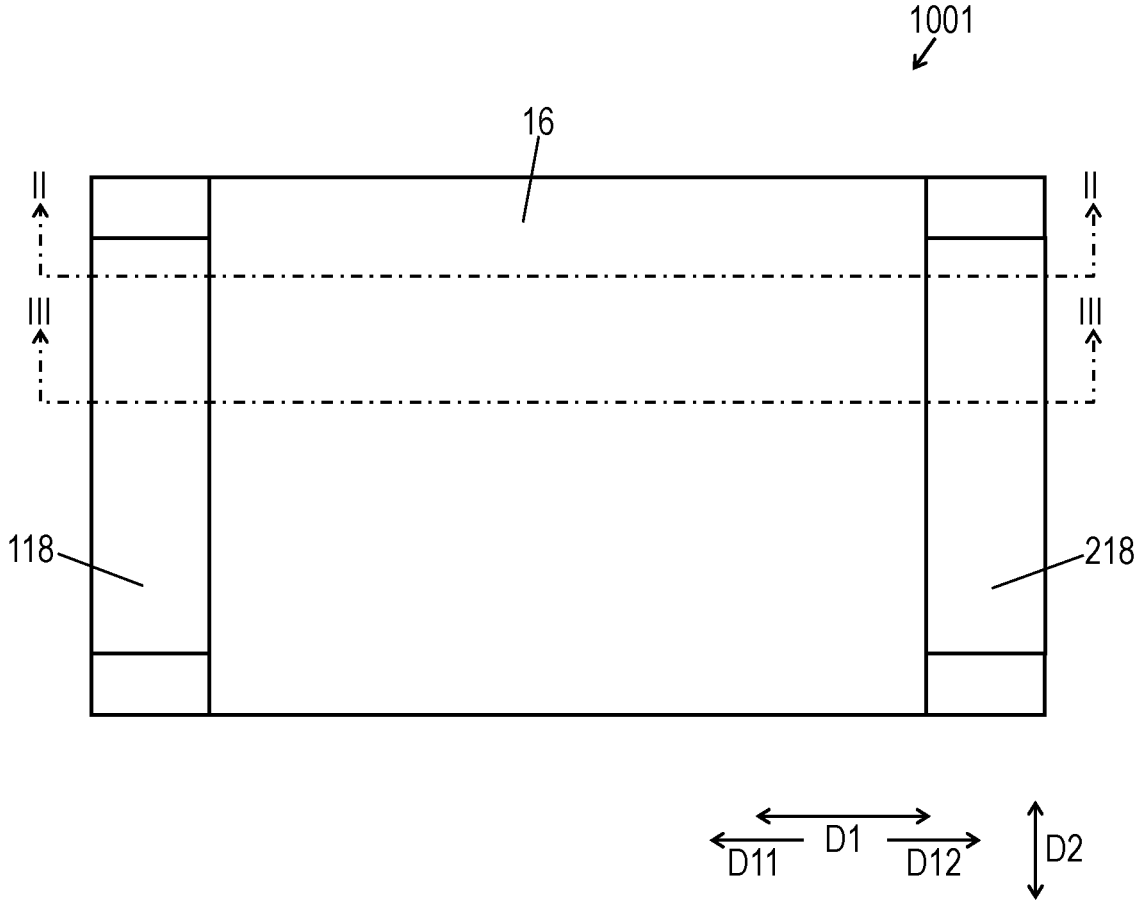
FIG. 1 is a top plan view of a chip resistor according to an exemplary embodiment.
Figure 2:
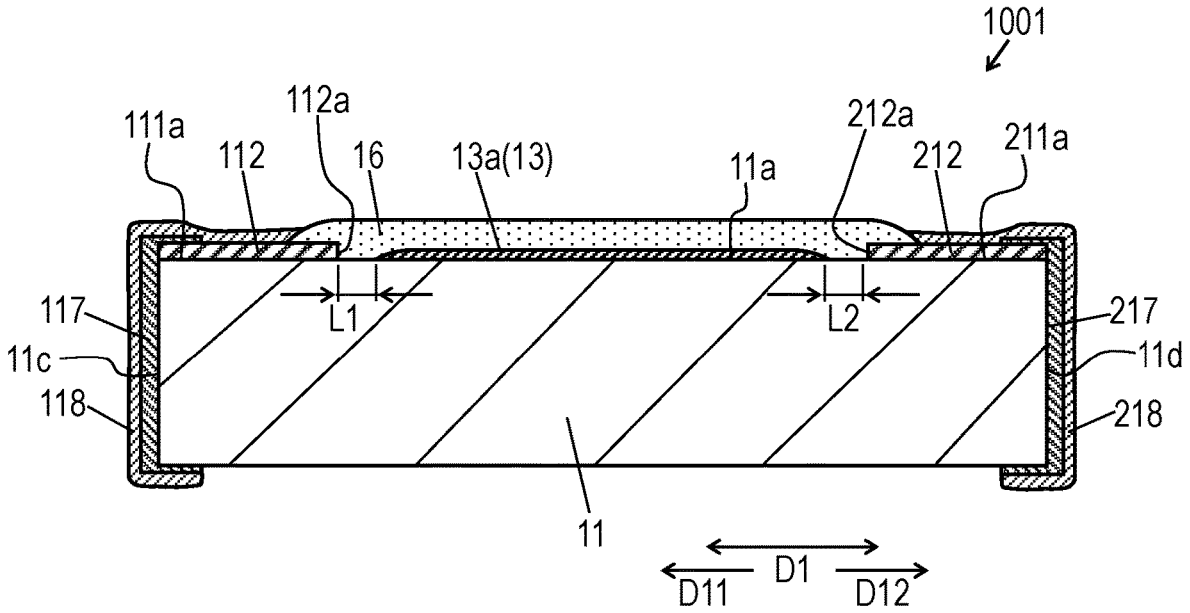
FIG. 2 is a cross-sectional view of the chip resistor along line II-II shown in FIG. 1.
Figure 3:
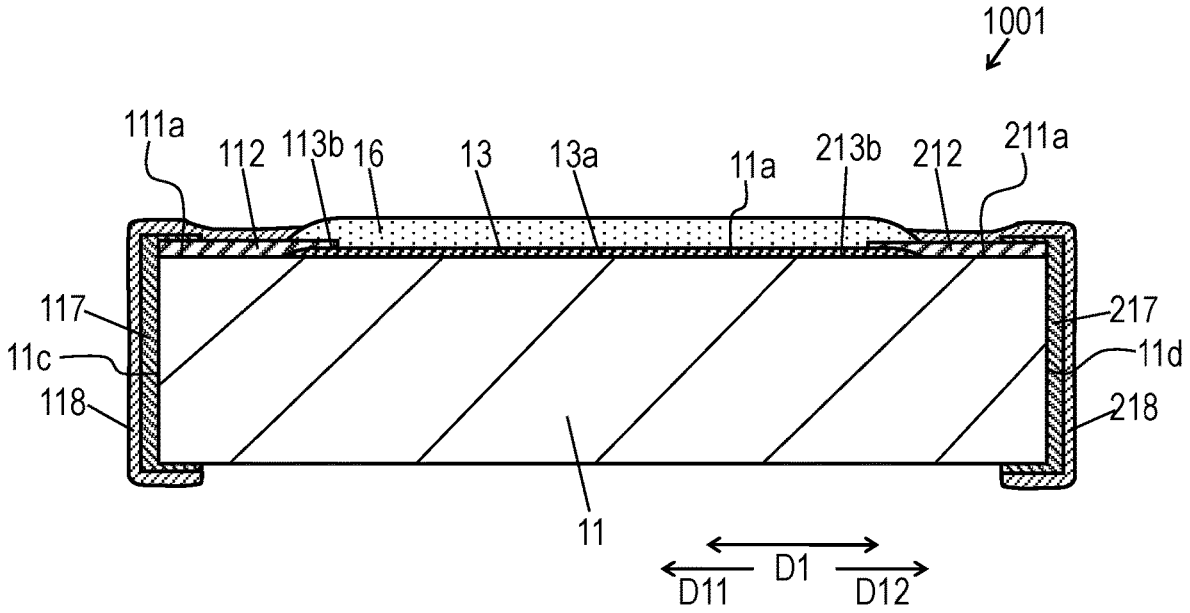
FIG. 3 is a cross-sectional view of the chip resistor along line III-III shown in FIG. 1.

FIG. 1 is a top plan view of chip resistor 1001 according to an exemplary embodiment. FIG. 2 is a cross-sectional view of chip resistor 1001 along line II-II shown in FIG. 1. FIG. 3 is a cross-sectional view of chip resistor 1001 along line III-III shown in FIG. 1.

Chip resistor 1001 includes insulating substrate 11, resistive element 13 provided at the center of upper surface 11*a* of insulating substrate 11, electrodes 112 and 212 provided on upper surface 11*a* of insulating substrate 11, and protective film 16 that covers resistive element 13 and parts of electrodes 112 and 212. Electrodes 112 and 212 partially overlap and contact resistive element 13. Electrodes 112 and 212 are provided on end portions 111*a* and 211*a* of upper surface 11*a* of insulating substrate 11 opposite to each other in predetermined direction D1, respectively. Resistive element 13 and electrodes 112 and 212 are arranged in direction D1 such that resistive element 13 is positioned between electrodes 112 and 212.

Figure 4:
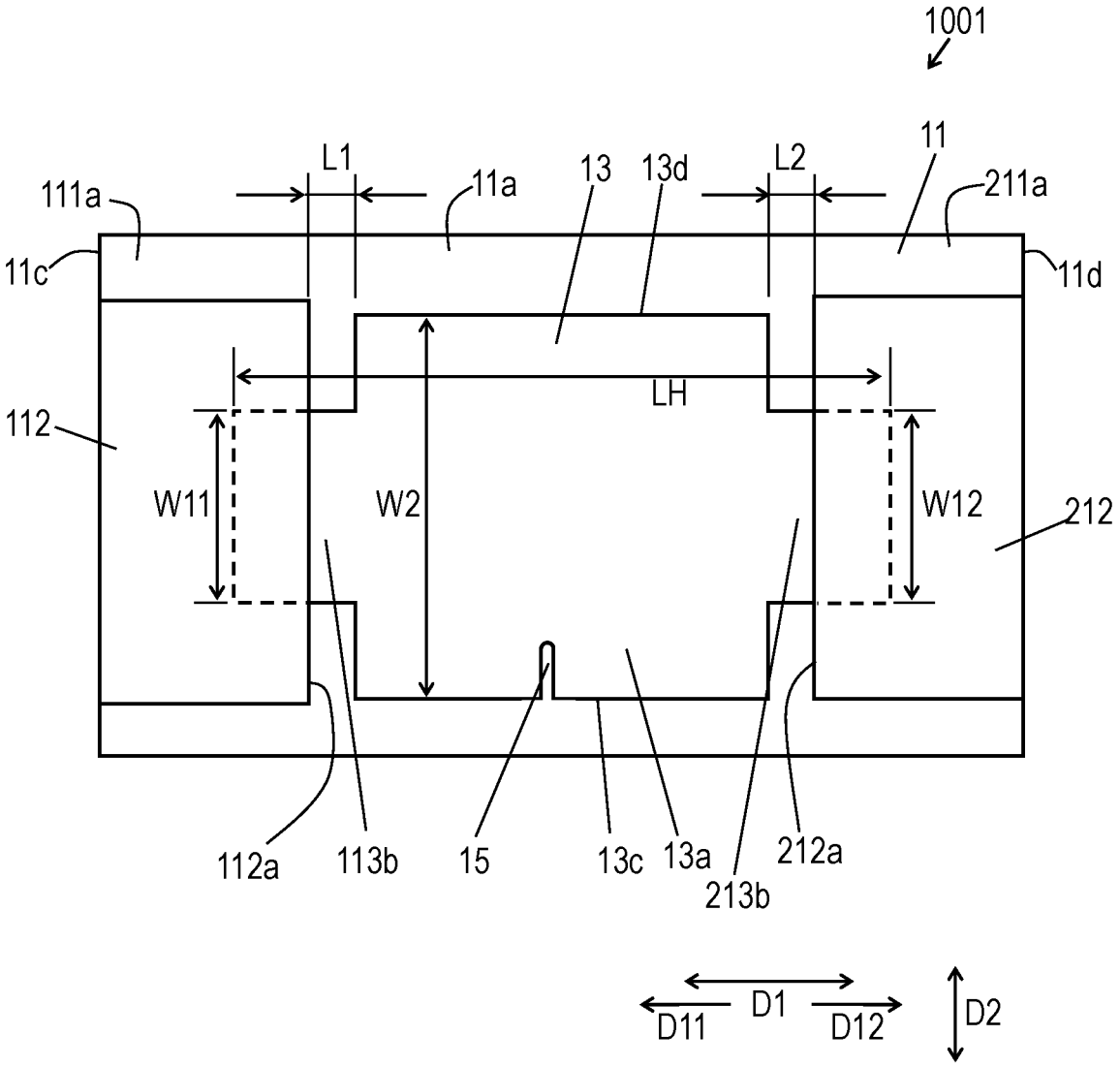
FIG. 4 is a top plan view of a main portion of the chip resistor shown in FIG. 1.

FIG. 4 is a top plan view of a main portion of chip resistor 1001, and illustrates resistive element 13 and electrodes 112 and 212. Resistive element 13 includes wide portion 13*a*, narrow portion 113*b* extending from wide portion 13*a* in direction D11 parallel with direction D1, and narrow portion 213*b* extends from wide portion 13*a* in direction D12 which is opposite to direction D11 and parallel with direction D1. Narrow portions 113*b* and 213*b* are parts extending from wide portion 13*a* in directions D11 and D12, respectively. Thus, wide portion 13*a* and narrow portions 113*b* and 213*b* are arranged in direction D1 such that wide portion 13*a* is positioned between narrow portions 113*b* and 213*b*. In accordance with the embodiment, respective widths W11 and W12 of narrow portions 113*b* and 213*b* in direction D2 perpendicular to direction D1 are smaller than width W2 of wide portion 13*a* along direction D2. Electrodes 112 and 212 are located away from wide portion 13*a*. Electrodes 112 and 212 overlap narrow portions 113*b* and 213*b* when viewed from above, respectively. Electrodes 112 and 212 contact narrow portions 113*b* and 213*b*, respectively. Electrodes 112 and 212 has ends 112*a* and 212*a* facing wide portion 13*a* in direction D1. Ends 112*a* and 212*a* of electrodes 112 and 212 in direction D1 are located away from wide portion 13*a* by distances L1 and L2, respectively, in direction D1. Wide portion 13*a* has side surfaces 13*c* and 13*d* that face opposite to each other in direction D2. Trimming groove 15 is formed in side surface 13*c* of wide portion 13*a*. Narrow portions 113*b* and 213*b* are positioned at the center of wide portion 13*a* in direction D2, and are located away from side surfaces 13*c* and 13*d* of wide portion 13*a*, respectively.

Widths W11 and W12 of narrow portions 113*b* and 213*b* range from 60% to 80% of width W2 of wide portion 13*a*. Each of distances L1 and L2 between wide portion 13*a* and respective one of electrodes 112 and 212 ranges from 10% to 20% of length LH of resistive element 13 in direction D1.

As illustrated in FIG. 2, insulating substrate 11 further has end surfaces 11*c* and 11*d*. End surface 11*c* is positioned at the end of insulating substrate 11 in direction D11 and connected to upper surface 11*a*. End face 11*d* is positioned at the end of insulating substrate 11 in direction D12 and connected to upper surface 11*a*. Chip resistor 1001 further includes end-surface electrodes 117 and 217 and plated layers 118 and 218. End-surface electrode 117 is provided on end surface 11*c* of insulating substrate 11 and is electrically connected to electrode 112. End-surface electrode 217 is provided on end face 11*d* of insulating substrate 11 and is electrically connected to electrode 212. Plated layer 118 is provided on a part of electrode 112 and on a surface of end-surface electrode 117. Plated layer 218 is provided on a part of electrode 212 and on a surface of end-surface electrode 217.

Insulating substrate 11 is made of alumina containing 96% of $Al_2O_3$. Upper surface 11*a* of insulating substrate 11 has a rectangular shape.

Electrodes 112 and 212 are formed by printing and sintering a thick film material made of a metal, such as copper, on end portions 111*a* and 211*a* of upper surface 11*a* of insulating substrate 11.

Resistive element 13 is formed by printing a thick film material made of a resist material, such as a copper-nickel alloy, a silver-palladium alloy, or ruthenium oxide, on upper surface 11*a* of insulating substrate 11, and then sintering the thick film material.

Electrodes 112 and 212 cover ends of narrow portions 113*b* and 213*b* of resistive element 13 located in directions D11 and D12.

A current flowing in wide portion 13*a* between electrodes 112 and 212 flows mainly in direction D1 within the range of the widths of narrow portions 113*b* and 213*b*. Trimming groove 15 has a length which overlaps none of narrow portions 113*b* and 213*b* when viewed in direction D1 in which the current flows.

Protective film 16 which covers resistive element 13 and the parts of electrodes 112 and 212 is made of an epoxy resin. As illustrated in FIG. 1, the width of protective film 16 in direction D2 is identical to the width of insulating substrate 11 in direction D2. Both side surfaces of protective film 16 in direction D2 are exposed from both end surfaces of insulating substrate 11 in direction D2.

End-surface electrodes 117 and 217 are provided on end surfaces 11*c* and 11*d* of insulating substrate 11, respectively. End-surface electrodes 117 and 217 are formed by printing conductive material made Ag and resin on end surfaces 11*c* and 11*d* of insulating substrate 11 and on parts of the upper surfaces of electrodes 112 and 212 that are exposed from protective film 16 such that end-surface electrodes 117 and 217 are electrically connected to the portions of the upper surfaces of electrodes 112 and 212, respectively. End-surface electrodes 117 and 217 may be formed by sputtering metal material.

Each of plated layers 118 and 218 includes a Ni-plated layer and a Sn-plated layer on a surface of the Ni-plated layer. The Ni-plated layer is formed on the surface of each of end-surface electrodes 117 and 217. Plated layers 118 and 218 contact protective film 16.

A method of manufacturing chip resistor 1001 will be described below.

First, a thick film material made of copper-nickel alloy, silver-palladium alloy, or ruthenium oxide is printed on upper surface 11*a* of insulating substrate 11, and is sintered, thereby providing resistive element 13 having wide portion 13*a* and narrow portions 113*b* and 213*b*.

Next, electrodes 112 and 212 are formed by printing and sintering a thick film material made of copper on end portions 111*a* and 211*a* of upper surface 11*a* of insulating substrate 11. At this moment, electrodes 112 and 212 are connected to narrow portions 113*b* and 213*b*, respectively while each of distances L1 and L2 between wide portion 13*a* and respective one of respective ends 112*a* and 212*a* of electrodes 112 and 212 are set to predetermined values. By changing distances L1 and L2, the effective length of resistive element 13 that functions as a resistor changes so as to adjust the resistance value between electrodes 112 and 212. In parts of narrow portions 113*b* and 213*b* of resistive element 13 that overlap and contact electrodes 112 and 212, a current flows through electrodes 112 and 212 which have a significantly lower resistance value than resistive element 13. Therefore, these parts of narrow portions 113*b* and 213*b* do not function as resistors. Accordingly, wide portion 13*a* and parts of narrow portions 113*b* and 213*b* of resistive element 13 that are exposed from electrodes 112 and 212 and contact none of electrodes 112 and 212 function as a resistor. In other words, the effective length of resistive element 13 is a length of the portion of resistive element 13 between ends 112*a* and 212*a* of electrodes 112 and 212 in direction D1.

Narrow portions 113*b* and 213*b* having widths W11 and W12 smaller than width W2 of wide portion 13*a* in direction D2 have higher resistance values per unit length in direction D1 than wide portion 13*a*. Therefore, the rate of a change of the resistance value with respect to a change of distances L1 and L2 is large. The resistance value can change over a wide range accordingly, and easily obtain a resistance value that is close to a predetermined value. Therefore, the resistance value can be adjusted precisely.

By previously calculating or measuring the relationship between the resistance value and each of distances L1 and L2, the relationship between each of distances L1 and L2 and the resistance value corresponding to the distances L1 and L2 is obtained. Based on this relationship, distances L1 and L2 corresponding to the predetermined resistance value are determined. In other words, by determining distances L1 and L2, the resistance value between electrodes 112 and 212 are determined.

When a predetermined resistance value cannot be obtained by merely changing distances L1 and L2, the length or width of trimming groove 15 is adjusted so as to finely adjust the resistance value.

Subsequently, protective film 16 is formed so as to cover at least resistive element 13. After that, end-surface electrodes 117 and 217 electrically connected to electrodes 112 and 212 are formed on end surfaces 11*c* and 11*d* of insulating substrate 11, respectively. After that, plated layers 118 and 218 are formed on parts of electrodes 112 and 212 and on the surfaces of end-surface electrodes 117 and 217, respectively.

Figure 10:
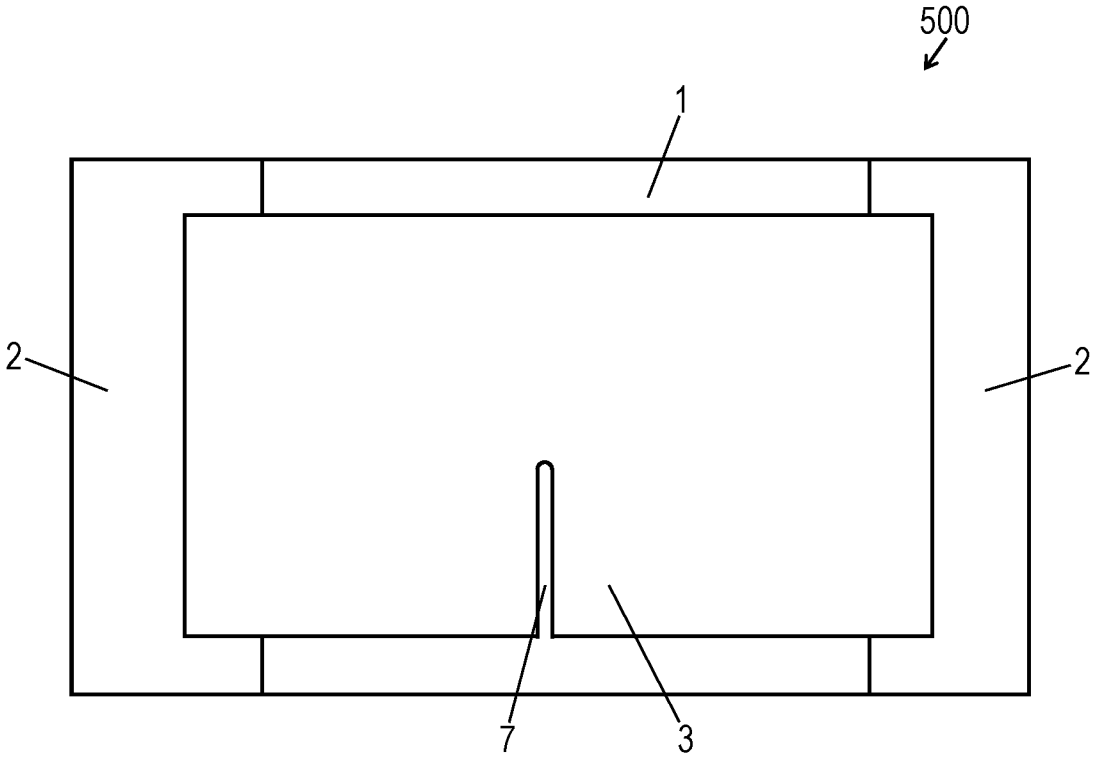
FIG. 10 Prior Art
FIG. 10 is a top plan view of a main portion of a conventional chip resistor.
Figure 11:
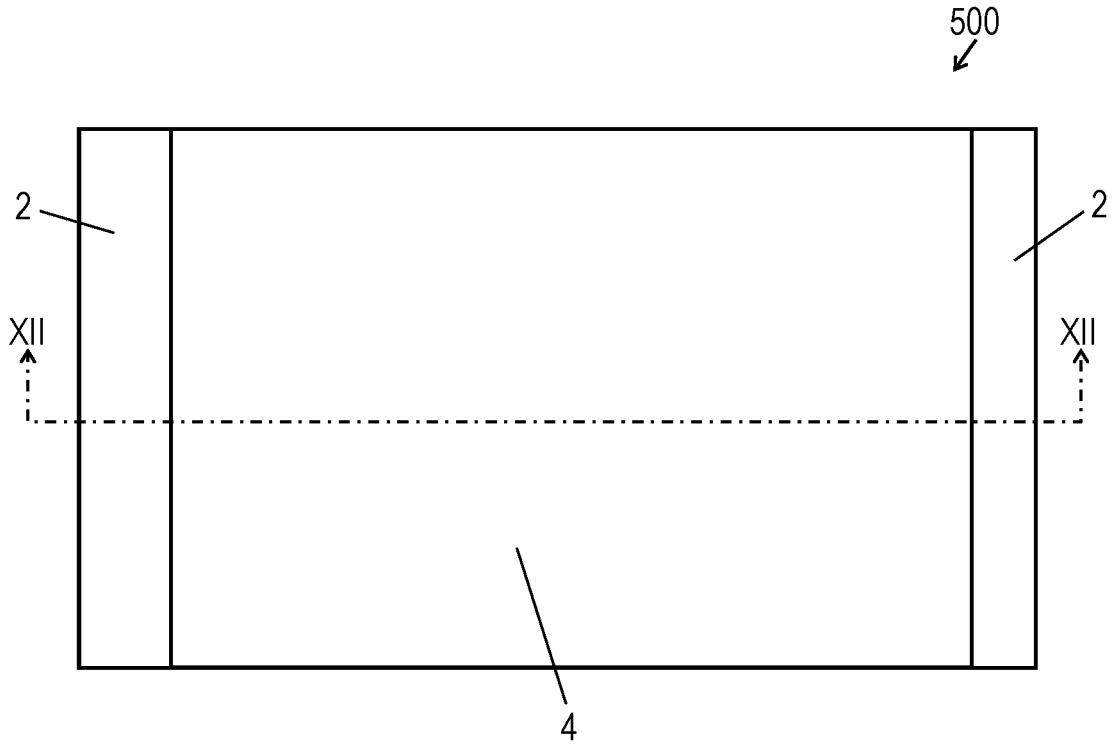
FIG. 11 Prior Art
FIG. 11 is a top plan view of the chip resistor shown in FIG. 10.
Figure 12:
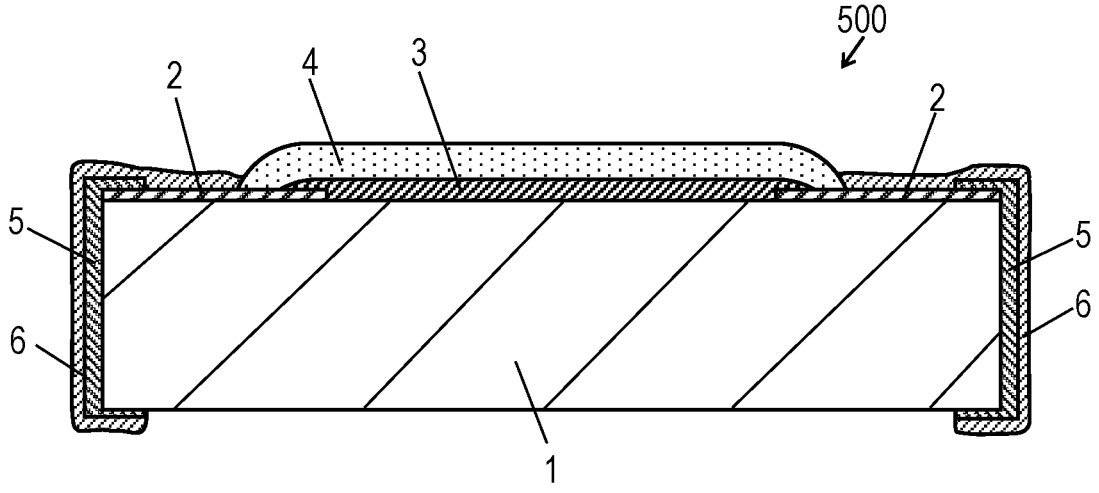
FIG. 12 Prior Art
FIG. 12 is a cross-sectional view of the chip resistor along line XII-XII shown in FIG. 11.

In conventional chip resistor 500 shown in FIGS. 10 to 12, the size of resistive element 3 is large in view of higher power that is required in recent years. When resistive element 3 is formed after the forming of upper-surface electrodes 2, the exposed area of upper-surface electrodes 2 becomes relatively small, which may result in various problems, such as connection failures at the position of a probe that measures a resistance value when modifying the resistance value, and poor connectivity with end-surface electrodes 5.

On the other hand, when upper-surface electrodes 2 is formed after the forming of resistive element 3 in order to provide a sufficient exposed area of upper-surface electrodes 2 in conventional chip resistor 500, the resistance value of resistive element 3 remains unknown until upper-surface electrodes are formed. Accordingly, when the resistance value exceeds a predetermined range after upper-surface electrodes 2 are formed, resistive element 3 and upper-surface electrodes 2 need to be formed from the beginning. Consequently, it is difficult to adjust the resistance value to a predetermined resistance value in mass production, and to improve the precision of resistance value.

In the above-described method of manufacturing chip resistor 1001 according to the embodiment, the resistance value can be adjusted by changing each of distances L1 and L2 between wide portion 13*a* and respective one of electrodes 112 and 212. As a result, the resistance value may be adjusted precisely, thus providing a precise resistance value regardless of the order of the forming of resistive element 13 and electrodes 112 and 212.

In other words, since the resistance value can be adjusted by each of distances L1 and L2 between wide portion 13*a* and respective one of electrodes 112 and 212, the resistance value can be adjusted precisely even if electrodes 112 and 212 are printed after printing resistive element 13.

In chip resistor 1001 according to the embodiment, the resistance value is adjusted coarsely by changing distances L1 and L2, and adjusted finely by forming trimming groove 15.

Since the resistance value is adjusted coarsely by changing distances L1 and L2, trimming groove 15 may have a small length. Trimming groove 15 having a small length shorter prevents the resistance value from fluctuating due to heat generated in resistive element 13 while forming trimming groove 15. Moreover, even if cracks are formed at an end portion of trimming groove 15, the current flowing between electrodes 112 and 212 flows within the range of the width of narrow portions 113*b* and 213*b*. Since the length of trimming groove 15 is determined such that trimming groove 15 overlaps none of narrow portions 113*b* and 213*b* when viewed in direction D1 in which the current flows, such cracks do not adversely affect the current significantly.

Widths W11 and W12 of narrow portions 113*b* and 213*b* in direction D2 range from 60% to 80% of width W2 of wide portion 13*a* in direction D2. Widths W11 and W12 larger than 80% of width W2 cause the rate of change of the resistance value with respect to the change of distances L1 and L2 to be excessively small, only 20% at most. On the other hand, widths W11 and W12 smaller than 60% of width W2 cause the resistance value of narrow portions 113*b* and 213*b* to be excessively large, which means that the rate of the change of the resistance value with respect to the change of distances L1 and L2 becomes extremely high. Moreover, the load on narrow portions 113*b* and 213*b* becomes excessively high due to the heat generated in narrow portions 113*b* and 213*b*.

One of widths W11 and W12 of narrow portions 113*b* and 213*b* may not necessarily be smaller than width W2 of wide portion 13*a*. Even in this case, the same advantageous effects are obtained.

Distances L1 and L2 may range preferably from 10% to 20% of length LH of resistive element 13 along direction D1. Distances L1 and L2 less than 10% of length LH of resistive element 13 may cause electrodes 112 and 212 to contact wide portion 13*a* of resistive element 13 due to size variations of electrodes 112 and 212 and resistive element 13. Distances L1 and L2 larger than 20% of length LH of resistive element 13 may cause the lengths of narrow portions 113*b* and 213*b* in direction D1 to be excessively large, and increase the resistance value excessively.

Distances L1 and L2 may be preferably range from 10 μm to 100 μm, and be equal to each other.

Figure 5:
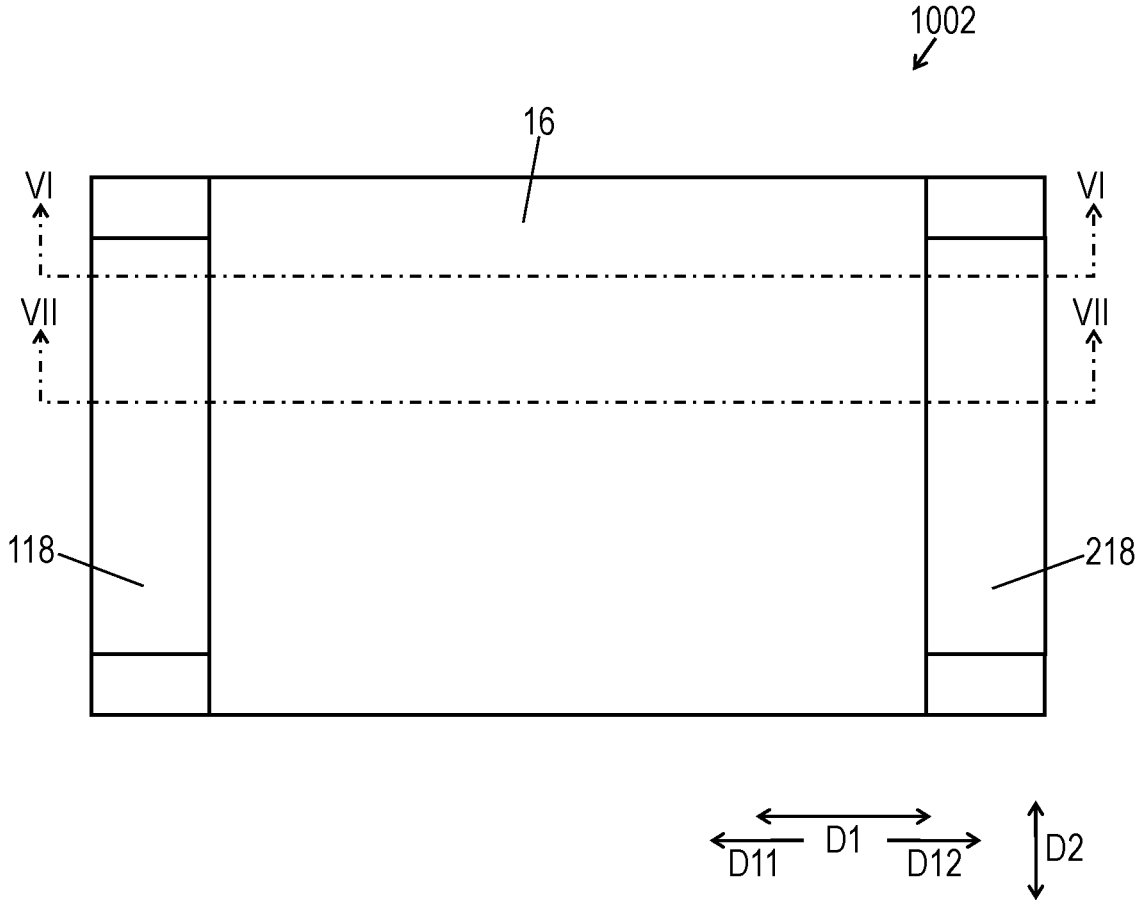
FIG. 5 is a top plan view of another chip resistor according to the embodiment.
Figure 6:
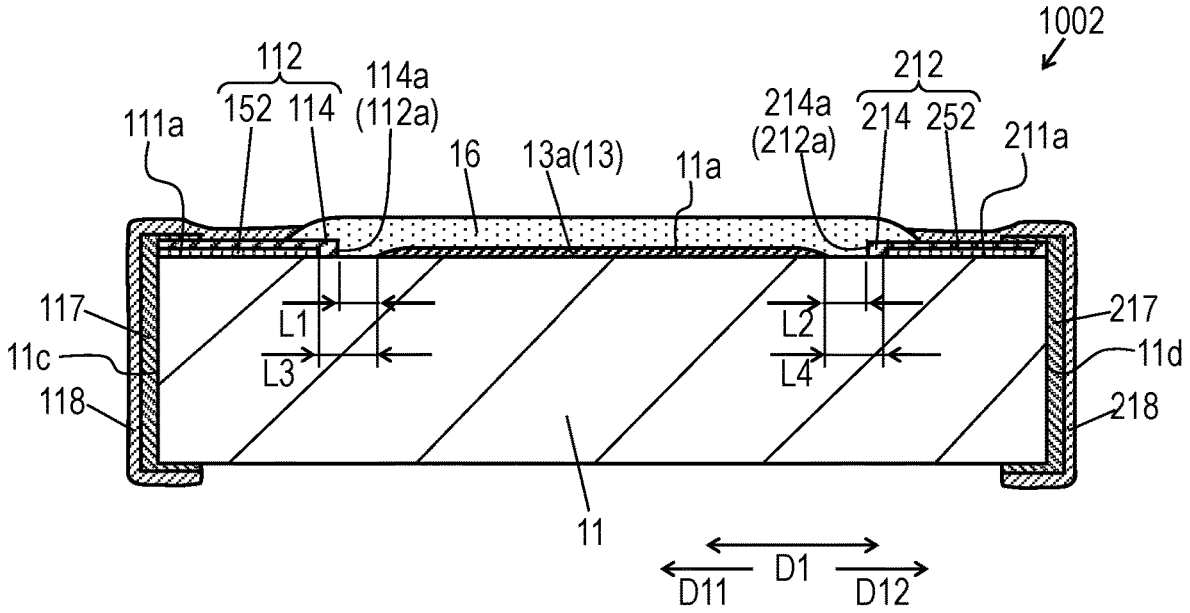
FIG. 6 is a cross-sectional view of the chip resistor along line VI-VI shown in FIG. 5.
Figure 7:
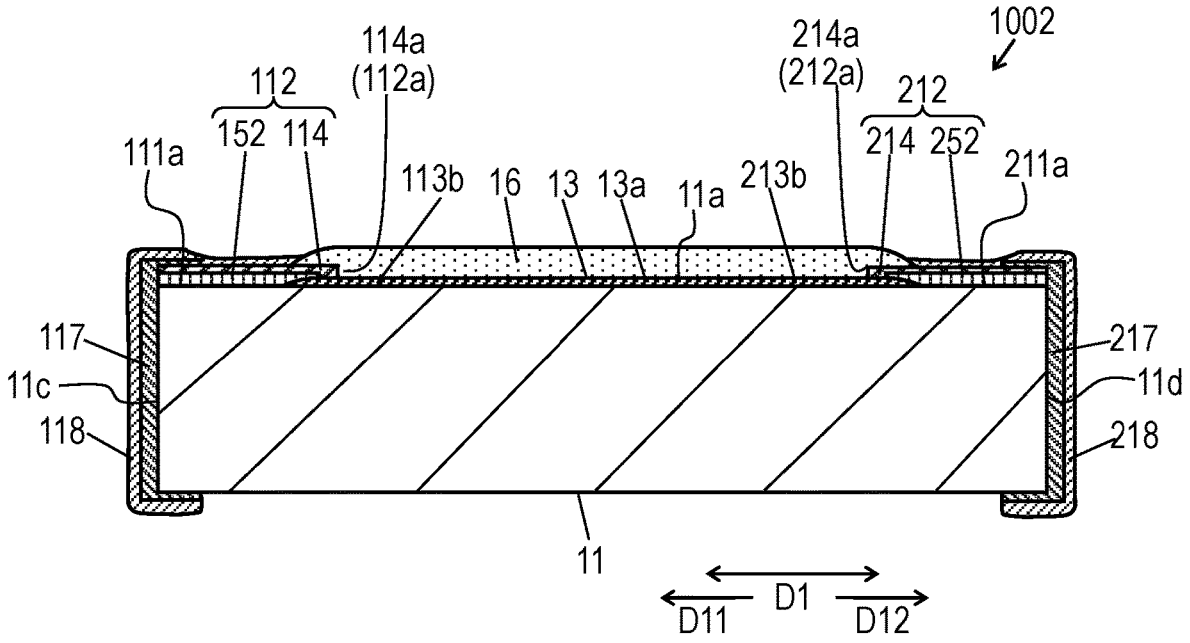
FIG. 7 is a cross-sectional view of the chip resistor along line VII-VII shown in FIG. 5.
Figure 8:
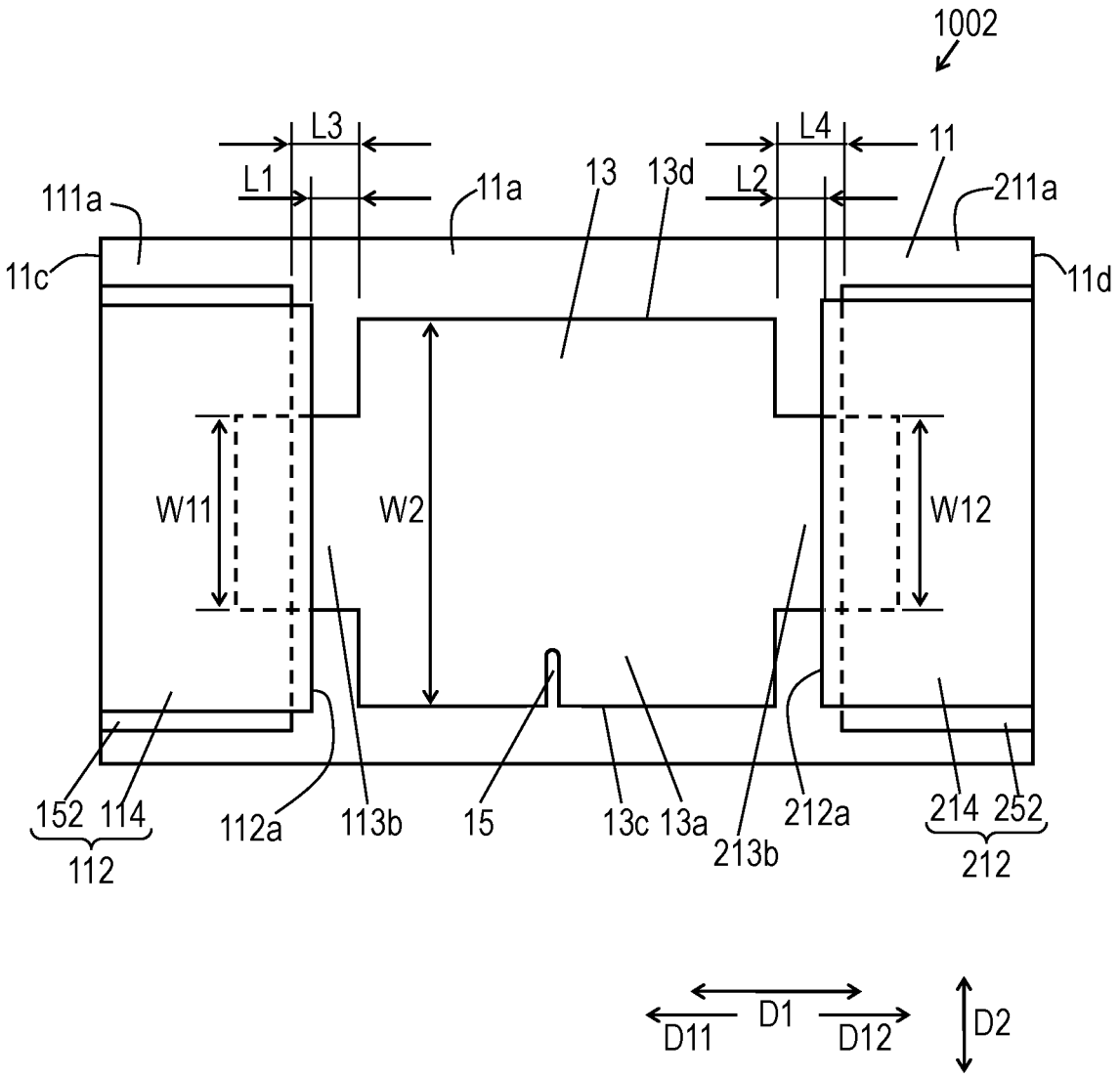
FIG. 8 is a top plan view of a main portion of the chip resistor shown in FIG. 5.

FIG. 5 is a top plan view of another chip resistor 1002 according to the embodiment. FIG. 6 is a cross-sectional view of chip resistor 1002 along line VI-VI shown in FIG. 5. FIG. 7 is a cross-sectional view of chip resistor 1002 along line VII-VII shown in FIG. 5. FIG. 8 is a top plan view of a main portion of chip resistor 1002. In FIGS. 5 to 8, components identical to those of chip resistor 1001 shown in FIGS. 1 to 4 are denoted by the same reference numerals. In chip resistor 1002 shown in FIGS. 5 to 8, the structure of electrodes 112 and 212 is different from that of chip resistor 1001 shown in FIGS. 1 to 4.

In chip resistor 1002 shown in FIGS. 5 to 8, electrode 112 includes electrode layer 152 provided on upper surface 11*a* of insulating substrate 11, and electrode layer 114 provided on an upper surface of electrode layer 152. Electrode 212 includes electrode layer 252 provided on upper surface 11*a* of insulating substrate 11, and electrode layer 214 provided on an upper surface of electrode layer 252. Electrode layers 114 and 152 extend to an end of upper surface 11*a* of insulating substrate 11 located in direction D11, and electrode layers 214 and 252 extend to an end of upper surface 11*a* of insulating substrate 11 located in direction D12.

Ends 114*a* and 214*a* of electrode layers 114 and 214 that face wide portion 13*a* of resistive element 13 constitute ends 112*a* and 212*a* of electrodes 112 and 212, respectively. Each of distances L3 and L4 between wide portion 13*a* and respective one of electrode layers 152 and 252 is larger than distances L1 and L2. Thus, end portions of electrode layers 114 and 214 including ends 114*a* and 214*a* contact upper surfaces of narrow portions 113*b* and 213*b* of resistive element 13, respectively.

Electrode layer 152 is located away from wide portion 13*a* by distance L3 that is larger than distance L1. Electrode layer 152 contacts narrow portion 113*b* while electrode layer 152 overlaps narrow portion 113*b* when viewed from above. Electrode layer 114 is located away from wide portion 13*a* by distance L1. Electrode layer 114 contacts narrow portion 113*b* and electrode layer 152 while electrode layer 114 overlaps narrow portion 113*b* and electrode layer 152 when viewed from above. Electrode layer 252 is located away from wide portion 13*a* by distance L4 that is larger than distance L2. Electrode layer 252 contacts narrow portion 213*b* while electrode layer 252 overlaps narrow portion 213*b* when viewed from above. Electrode layer 214 is located away from wide portion 13*a* by distance L2. Electrode layer 214 contacts narrow portion 213*b* and electrode layer 252 while electrode layer 214 overlaps narrow portion 213*b* and electrode layer 252 when viewed from above.

Electrode layers 152 and 252 are made of the same material as electrodes 112 and 212 of chip resistor 1001 shown in FIGS. 1 to 4. Electrode layers 114 and 214 are made of the same material as electrode layers 152 and 252.

Electrode layers 114 and 214 are relatively thin, and accordingly, have ends 114*a* and 214*a* with precisely, thereby providing the resistance value precisely.

Electrode layers 114 and 214 allow the surfaces of electrodes 112 and 212 to be smooth. This configuration allows plated layers 118 and 218 to be connected firmly to the surfaces of electrodes 112 and 212. When chip resistor 1002 is in use, a current flows from plated layers 118 and 218 into resistive element 13 mainly through electrode layers 114 and 214. For this reason, electrode layers 114 and 214 preferably extend to end faces 11*c* and 11*d* of insulating substrate 11 and contact narrow portions 113*b* and 213*b* of resistive element 13, respectively.

Figure 9:
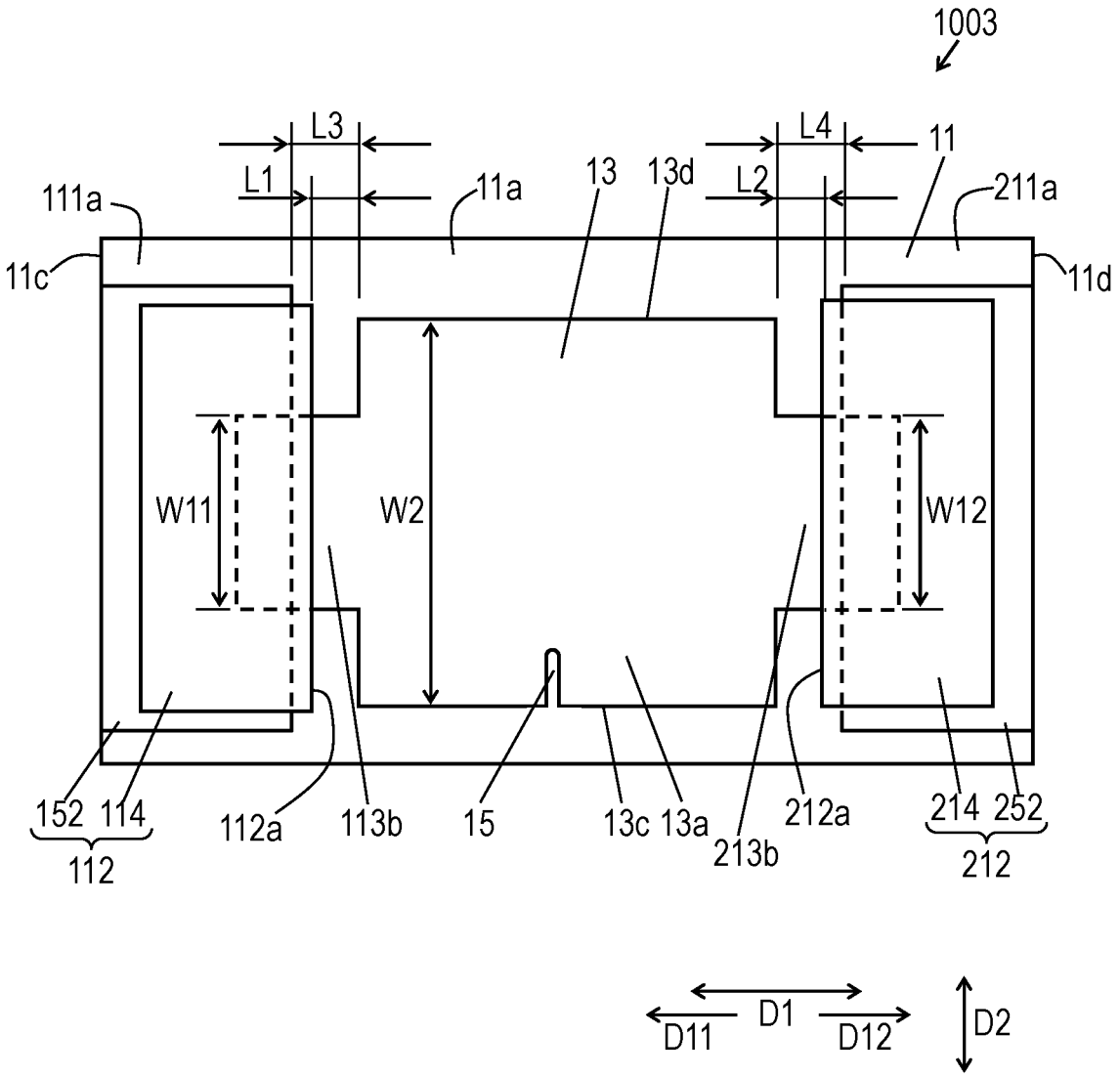
FIG. 9 is a top plan view of a main portion of still another chip resistor according to the embodiment.

FIG. 9 is a top plan view of a main portion of still another chip resistor 1003 according to the embodiment. In FIG. 9, components identical to those of chip resistor 1002 shown in FIGS. 5 to 8 are denoted by the same reference numerals. In chip resistor 1002 shown in FIG. 9, electrode layers 114 and 214 do not extend to end surfaces 11*c* and 11*d* of insulating substrate 11, respectively. The resistance value of chip resistor 1003 may be adjusted accurately by changing distances L1 and L2 between wide portion 13*a* and respective electrode layers 114 and 214.

In the above embodiment, terms, such as "upper surface" and "when viewed from above", indicating directions merely indicate relative directions determined only by relative positional relationships of the structural components of the chip resistor, and do not indicate absolute directions, such as a vertical direction.

REFERENCE MARKS IN THE DRAWINGS

11 insulating substrate
13 resistive element
13*a* wide portion
15 trimming groove
112 electrode (first electrode)
113*b* narrow portion (first narrow portion)
114 electrode layer (second electrode layer)
152 electrode layer (first electrode layer)
212 electrode (second electrode)
213*b* narrow portion (second narrow portion)
214 electrode layer (fourth electrode layer)
252 electrode layer (third electrode layer)

The invention claimed is:

1. A method of manufacturing a chip resistor having a predetermined resistance value, the method comprising:

providing a resistive element on an upper surface of an insulating substrate, the resistive element including a wide portion, a first narrow portion extending from the wide portion, and a part extending from the wide portion, the first narrow portion having a smaller width than the wide portion;

providing a first electrode on a first end portion of the upper surface of the insulating substrate, the first electrode being located away from the wide portion by a first distance, the first electrode contacting the first narrow portion, the first electrode overlapping the first narrow portion when viewed from above;

providing a second electrode on a second end portion of the upper surface of the insulating substrate, the second electrode contacting the part of the resistive element, the second electrode overlapping the part of the resistive element when viewed from above; and determining the first distance so as to cause a resistance value between the first electrode and the second electrode to be the predetermined resistance value, wherein said providing the first electrode comprises:

providing a first electrode layer located away from the wide portion by a second distance larger than the first distance, the first electrode layer contacting the first narrow portion, the first electrode layer overlapping the first narrow portion when viewed from above; and providing a second electrode layer located away from the wide portion by the first distance, the second electrode layer contacting the first narrow portion and the first electrode layer, the second electrode layer overlapping the first narrow portion and the first electrode layer when viewed from above.

2. The method of claim 1, further comprising:

adjusting the resistance value by forming a trimming groove in the wide portion.

3. The method of claim 2, wherein the wide portion, the first narrow portion, and the part are arranged in a predetermined direction such that the wide portion is positioned between the first narrow portion and the part of the resistive element, and wherein said adjusting the resistance value comprises adjusting the resistance value by forming the trimming groove in the wide portion such that the trimming groove overlaps none of the first narrow portion and the part of the resistive element when viewed in the predetermined direction.

4. A method of manufacturing a chip resistor having a predetermined resistance value, the method comprising:

providing a resistive element on an upper surface of an insulating substrate, the resistive element including a wide portion, a first narrow portion extending from the wide portion, and a part extending from the wide portion, the first narrow portion having a smaller width than the wide portion;

providing a first electrode on a first end portion of the upper surface of the insulating substrate, the first electrode being located away from the wide portion by a first distance, the first electrode contacting the first narrow portion, the first electrode overlapping the first narrow portion when viewed from above;

providing a second electrode on a second end portion of the upper surface of the insulating substrate, the second electrode contacting the part of the resistive element, the second electrode overlapping the part of the resistive element when viewed from above; and determining the first distance so as to cause a resistance value between the first electrode and the second electrode to be the predetermined resistance value, wherein the part of the resistive element is a second narrow portion extending from the wide portion and having a smaller width than the wide portion, wherein said providing the second electrode on the second end portion of the upper surface of the insulating substrate comprises providing the second electrode on the second end portion of the upper surface of the insulating substrate such that the second electrode is located away from the wide portion by a second distance, the second electrode contacts the second narrow portion, and the second electrode overlaps the second narrow portion when viewed from above, wherein said determining the first distance so as to cause the resistance value between the first electrode and the second electrode to be the predetermined resistance value comprises determining the first distance and the second distance so as to cause the resistance value between the first electrode and the second electrode to be the predetermined resistance value, wherein said providing the first electrode comprises:

providing a first electrode layer located away from the wide portion by a third distance larger than the first distance, the first electrode layer contacting first narrow portion, the first electrode layer overlapping the first narrow portion when viewed from above; and providing a second electrode layer located away from the wide portion by the first distance, the second electrode layer contacting the first narrow portion and the first electrode layer, the second electrode layer overlapping the first narrow portion and the first electrode layer when viewed from above, and wherein said providing the second electrode comprises:

providing a third electrode layer located away from the wide portion by a fourth distance larger than the second distance, the third electrode layer contacting the second narrow portion, the third electrode layer overlapping the second narrow portion when viewed from above; and providing a fourth electrode layer located away from the wide portion by the second distance, the fourth electrode layer contacting the second narrow portion and the third electrode layer, the fourth electrode layer overlapping the second narrow portion and the third electrode layer when viewed from above.

5. The method of claim 4, further comprising:

adjusting the resistance value by forming a trimming groove in the wide portion.

6. The method of claim 5, wherein the wide portion, the first narrow portion, and the second narrow portion are arranged in a predetermined direction such that the wide portion is positioned between the first narrow portion and the second narrow portion, and wherein said adjusting the resistance value comprises adjusting the resistance value by forming the trimming groove in the wide portion such that the trimming groove overlaps none of the first narrow portion and the second narrow portion when viewed in the predetermined direction.

7. A chip resistor comprising:

an insulating substrate;

a first electrode provided on a first end portion of an upper surface of the insulating substrate;

a second electrode provided on a second end portion of the upper surface of the insulating substrate;

a resistive element provided on the upper surface of the insulating substrate and connected to the first electrode and the second electrode, the resistive element overlapping the first electrode and the second electrode;

a third electrode covering the first electrode; and a fourth electrode covering the second electrode, wherein the resistive element includes a wide portion, a first narrow portion extending from the wide portion, and a part extending from the wide portion, the wide portion having a trimming groove provided therein, a width of a first narrow portion being smaller than a width of the wide portion, wherein the first electrode is connected to the first narrow portion of the resistive element, is located away from the wide portion by a first distance, and overlaps the first narrow portion of the resistive element, wherein the second electrode is connected to the part of the resistive element and overlaps the part of the resistive element, and wherein the width of the first narrow portion ranges from 60% to 80% of the width of the wide portion.

8. The chip resistor of claim 7, wherein the first distance ranges from 10% to 20% of a total length of the resistive element.

9. The chip resistor of claim 7, wherein the wide portion, the first narrow portion, and the part are arranged in a predetermined direction such that the wide portion is positioned between the first narrow portion and the part of the resistive element, and wherein the trimming groove does not overlap the first narrow portion or the part of the resistive element when viewed in the predetermined direction.

10. The chip resistor of claim 7, wherein the part of the resistive element is a second narrow portion extending from the wide portion and having a smaller width than the wide portion, wherein the second electrode is connected to the second narrow portion of the resistive element, is located away from the wide portion by a second distance, and overlaps the second narrow portion of the resistive element, wherein the width of the second narrow portion ranges from 60% to 80% of the width of the wide portion.

11. The chip resistor of claim 10, wherein the second distance ranges from 10% to 20% of a total length of the resistive element.

12. The chip resistor of claim 10, wherein the wide portion, the first narrow portion, and the second narrow portion are arranged in a predetermined direction such that the wide portion is positioned between the first narrow portion and the second narrow portion, and wherein the trimming groove overlaps none of the first narrow portion and the second narrow portion of the resistive element when viewed in the predetermined direction.

* * * * *